US010036236B1

(12) United States Patent
Sullivan et al.

(10) Patent No.: US 10,036,236 B1
(45) Date of Patent: Jul. 31, 2018

(54) SETTING TOOL IGNITER SYSTEM AND METHOD

(71) Applicant: GEODynamics, Inc., Millsap, TX (US)

(72) Inventors: Shelby L. Sullivan, Minot, ND (US); Johnny Joslin, Godley, TX (US); Robert E. Davis, Joshua, TX (US); John T. Hardesty, Weatherford, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 15/848,039

(22) Filed: Dec. 20, 2017

Related U.S. Application Data

(60) Provisional application No. 62/543,143, filed on Aug. 9, 2017.

(51) Int. Cl.
*E21B 43/11* (2006.01)
*E21B 43/1185* (2006.01)

(52) U.S. Cl.
CPC ..... *E21B 43/11855* (2013.01)

(58) Field of Classification Search
CPC ..... E21B 23/04; E21B 23/06; E21B 43/1185; E21B 43/116
See application file for complete search history.

(56) References Cited

U.S. PATENT DOCUMENTS 6,164,375 A * 12/2000 Carisella ..... E21B 23/04 166/373
6,257,331 B1 * 7/2001 Blount ..... E21B 23/04 166/123
2005/0241824 A1 * 11/2005 Burris, II ..... E21B 23/00 166/255.1
2015/0000509 A1 * 1/2015 Current ..... E21B 43/11 89/1.15
2015/0068723 A1 * 3/2015 Wells ..... E21B 33/134 166/55.1
2015/0107852 A1 * 4/2015 Southgate ..... E21B 47/01 166/378
2015/0330192 A1 * 11/2015 Rogman ..... E21B 43/116 166/297
2016/0115753 A1 * 4/2016 Frazier ..... E21B 23/06 166/53
2017/0044865 A1 * 2/2017 Sabins ..... E21B 33/13
2017/0051586 A1 * 2/2017 Wells ..... E21B 43/1185

* cited by examiner

*Primary Examiner* — Jennifer H Gay
(74) *Attorney, Agent, or Firm* — Patent Portfolio Builders PLLC

(57) ABSTRACT

There is a downhole tool that includes a switch sub having a bore and a bulkhead extending along a longitudinal axis, wherein the bulkhead has a bulkhead bore that fluidly communicates with (i) the bore and (ii) an outside of the switch sub; and an igniter system located inside the bulkhead. The igniter system is configured to ignite an energetic material.

24 Claims, 14 Drawing Sheets

SETTING TOOL IGNITER SYSTEM AND METHOD

CROSS REFERENCE TO RELATED APPLICATIONS

This application claims priority and benefit from U.S. Provisional Patent Application No. 62/543,143, filed on Aug. 9, 2017, for "Perforating Gun Ignitor System and Method," the content of which is incorporated in its entirety herein by reference.

BACKGROUND

Technical Field

Embodiments of the subject matter disclosed herein generally relate to perforating guns and associated fracturing operations, and more specifically, to methods and systems for activating a setting tool to plug a well.

Discussion of the Background

In the oil and gas field, once a well 100 is drilled to a desired depth H relative to the surface 110, as illustrated in FIG. 1, and the casing 102 protecting the wellbore 104 has been installed and cemented in place, it is time to connect the wellbore 104 to the subterranean formation 106 to extract the oil and/or gas. This process of connecting the wellbore to the subterranean formation may include a step of plugging the well with a plug 112, a step of perforating the casing 102 with a perforating gun assembly 114 such that various channels 116 are formed to connect the subterranean formation to the inside of the casing 102, a step of removing the perforating gun assembly, and a step of fracturing the various channels 116.

Some of these steps require to lower in the well 100 a wireline 118, which is electrically and mechanically connected to the perforating gun assembly 114, and to activate the gun assembly and/or a setting tool 120 attached to the perforating gun assembly. Setting tool 120 is configured to hold plug 112 prior to plugging the well. FIG. 1 shows the setting tool 120 disconnected from the plug 112, indicating that the plug has been set in the casing and the setting tool 120 has been disconnected from the plug 112.

FIG. 1 shows the wireline 118, which includes at least one electrical connector, being connected to a control interface 122, located on the ground 110, above the well 100. An operator of the control interface may send electrical signals to the perforating gun assembly and/or setting tool for (1) setting the plug 112 and (2) disconnecting the setting tool from the plug. A fluid 124, (e.g., water, water and sand, fracturing fluid, etc.) may be pumped by a pumping system 126, down the well, for moving the perforating gun assembly and the setting tool to a desired location, e.g., where the plug 112 needs to be deployed, and also for fracturing purposes.

The above operations may be repeated multiple times for perforating the casing at multiple locations, corresponding to different stages of the casing. Note that in this case, multiple plugs 112 and 112' may be used for isolating the respective stages from each other during the perforating phase and/or fracturing phase.

FIG. 2 shows a traditional perforating gun assembly and setting tool system 200. From left to right, FIG. 2 shows a perforating gun assembly 214, a switch sub 230, an adapter 232, a setting assembly 234, a quick change tool 240, a setting tool 220, a setting tool assembly kit 250, and a plug 212. These devices are mechanically connected to each other in the order shown in the figure. The quick change tool 240 is made of two parts 240A and 240B that can rotate one with respect to the other. This means that there is no need to rotate the perforating gun assembly and the setting tool when connecting them to each other as the quick change tool performs that function. The quick change tool 240 is connected to the perforating gun assembly 214 through the switch sub 230. The switch sub 230 houses a switch (not shown) that activates a detonator 215 of the perforating gun assembly. An igniter 222, which activates the setting tool, is located in a firing head 224 within the setting tool 220.

The system 200 shown in FIG. 2 is not only complex (many parts that have to be connected together, which means valuable time being spent on assembling the tool and not on extracting the oil and gas) and large (which means that the system is expensive as each part requires special manufacturing and care), but also suffers from the following deficiency. To set up the plug 212 (or plug 112 in FIG. 1), the setting tool 220 needs to be actuated. This process involves firing the igniter 222. Flames from the igniter 222 ignite an power charge located in the setting tool, which actuate one or more pistons inside the setting tool. The movement of the one or more pistons inside the setting tool actuates one part of the plug 212 in one direction and another part of the plug in an opposite direction, which sets the plug. However, burning the power charge inside the setting tool results in high pressure smoke and soot. The smoke and/or soot travel through the holder of the igniter to the quick change tool and other components of the system 200. The soot and pressurized smoke can damage some of these components and/or deposit carbon on these components. When the system 200 is brought to the surface and prepared for a new use, while the igniter and the power charge are replaced, the other components of the system 200 may be reused. However, some other components of the system 200 (e.g., electronic parts present inside system 200 or their holders) are now covered in soot (carbon), which would negatively impact the electrical connections inside the system. Thus, a cleaning process is required for all these components prior to adding the new igniter and power charge. This cleaning process is tedious, slowing down the next step of completion and can result in a misrun if not done properly.

Thus, it is desirable to develop an improved perforating gun assembly and setting tool system that is not affected by the soot and smoke produced by the igniter and the power charge, and which can be cleaned up in a shorter period of time for a new deployment in the well.

SUMMARY

According to an embodiment, there is a downhole tool that includes a switch sub having a bore and a bulkhead extending along a longitudinal axis, wherein the bulkhead has a bulkhead bore that fluidly communicates with (i) the bore and (ii) an outside of the switch sub, and an igniter system located inside the bulkhead. The igniter system is configured to ignite an energetic material.

According to another embodiment, there is a downhole tool having a switch sub configured to be connected between (i) a perforating gun assembly and (ii) an adapter or a setting tool and an igniter system located inside the switch sub. The igniter system is configured to ignite an energetic material.

According to still another embodiment, there is a method for manufacturing an igniter system for a downhole tool. The method includes placing the igniter system inside a housing, placing the housing in a bulkhead of a switch sub, the switch sub having a bore, and the bore and the bulkhead extending along a longitudinal axis, wherein a bulkhead bore of the bulkhead fluidly communicates with (i) the bore and (ii) an outside of the switch sub, and attaching a nut to an inside wall of the switch sub to hold the igniter system within the bulkhead bore. The igniter system is configured to ignite an energetic material.

BRIEF DESCRIPTON OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a perforating gun assembly attached to a setting tool through a switch sub. However, the embodiments discussed herein are not limited to such elements.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
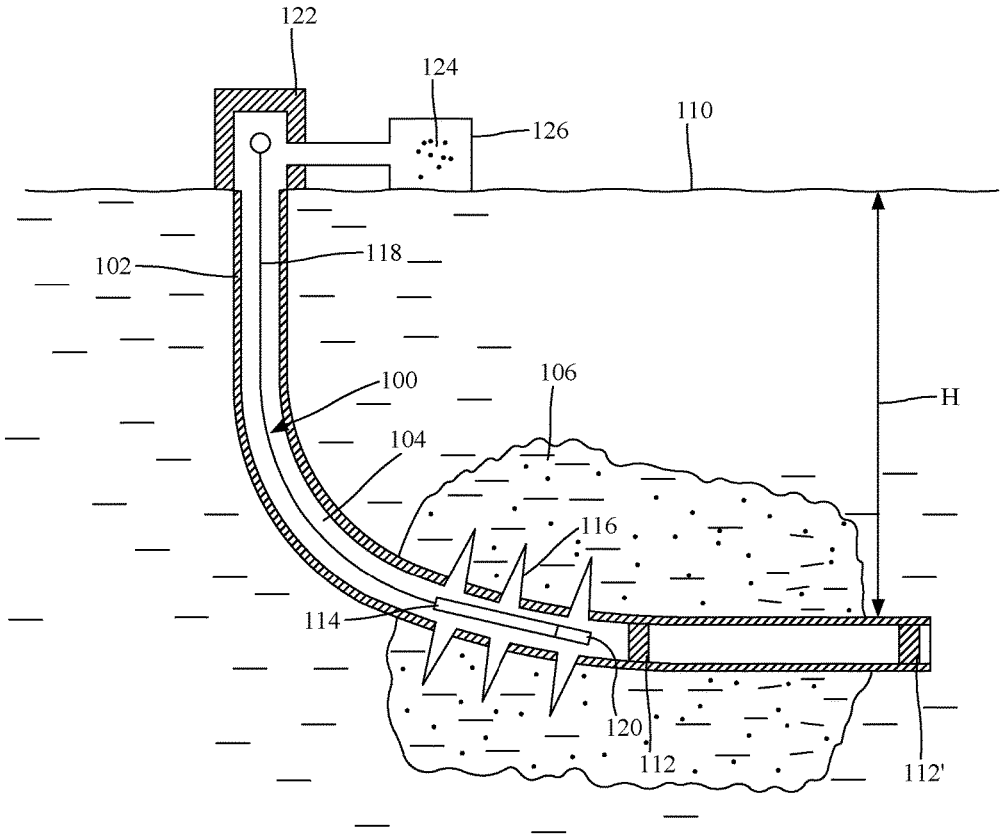
FIG. 1 (Background Art)
FIG. 1 illustrates a well and associated equipment for well completion operations.
Figure 2:
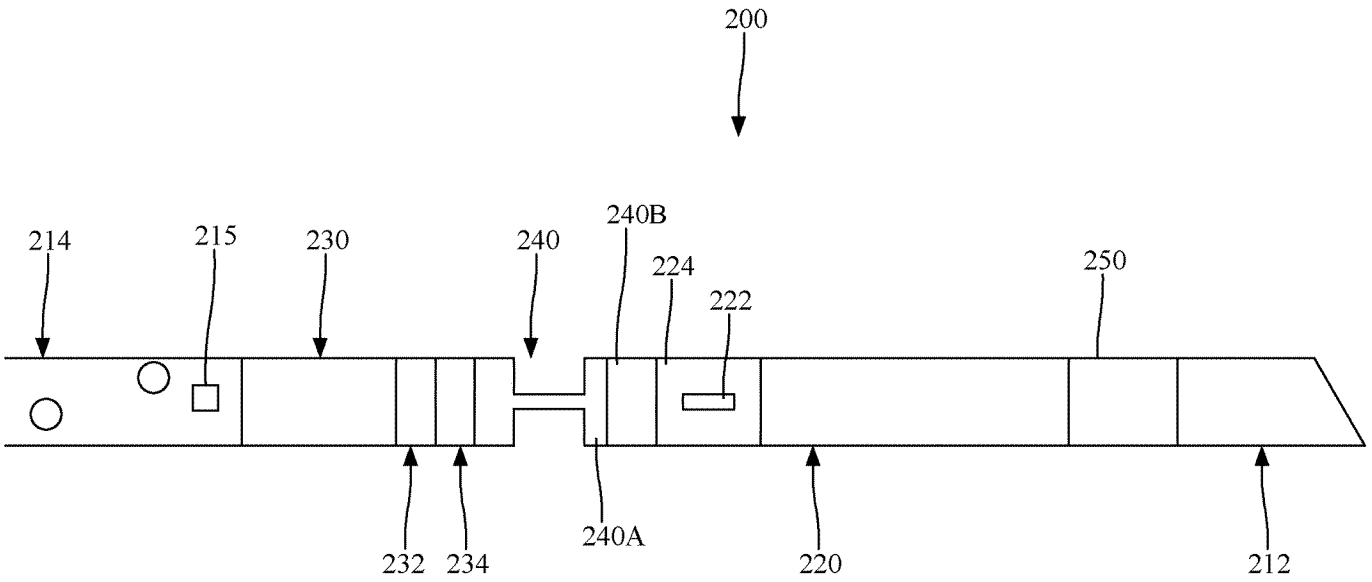
FIG. 2 (Background Art)
FIG. 2 illustrates a traditional perforating gun assembly and tool setting system.
Figure 3:
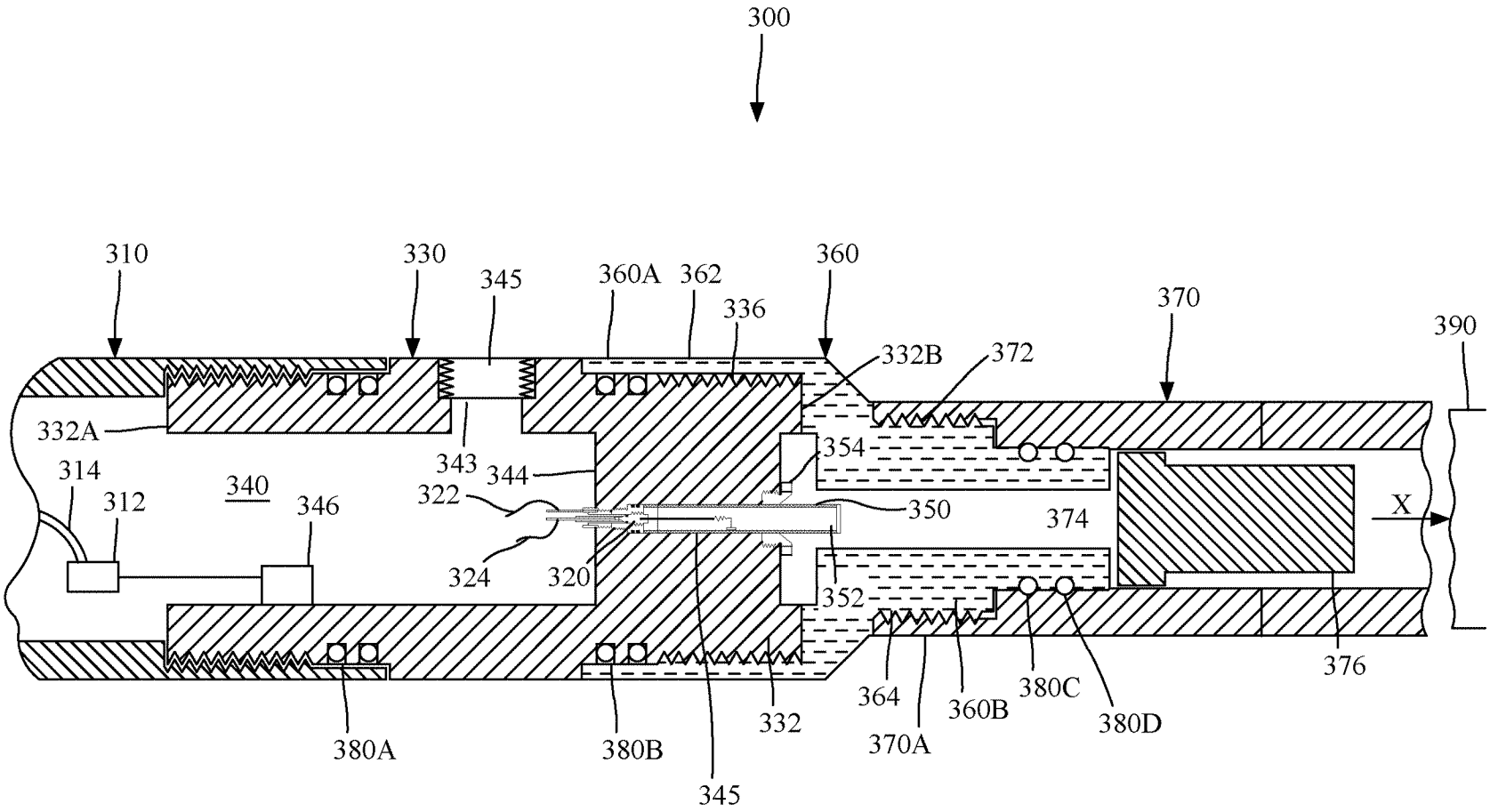
FIG. 3 illustrates a downhole tool having an igniter system located inside a switch sub.

According to an embodiment illustrated in FIG. 3, a downhole tool 300 used to plug a well and/or to perforate a casing placed in the well includes a perforating gun assembly 310, a switch sub 330, an adapter 360, a setting tool 370 and a plug 390. These elements are connected to each other in this order and as shown in the figure. Comparative to the system 200 shown in FIG. 2, the present system includes fewer components (only four instead of six), it is easier to assemble, and the placement of the igniter system (to be discussed later) limits the propagation of smoke and soot to other components (e.g., electrical components) and makes the process of cleaning up the downhole tool easier.

More specifically, the embodiment shown in FIG. 3 has an igniter system 320 placed in a bulkhead 344 formed in a body 332 of the switch sub 330. In one application, the bulkhead is part of the body 332 of the switch sub, i.e., it is made integrally in the body. In this way, the bulkhead can withstand a detonation of an adjacent gun without being deformed and without allowing smoke or soot to pass by. The switch sub 330 also has a bore/chamber 340. The bulkhead 344 has an bulkhead bore 345 (see FIG. 4) that fluidly communicates with the bore/chamber 340 and extends along a longitudinal axis X. Body 332 of the switch sub 330 has a first end 332A that faces the perforating gun assembly 310 and a second end 332B that faces the adapter 360. In one application, as discussed later, the second end 332B may face directly the setting tool 370 as the adapter 360 is removed. Body 332, which is illustrated in more detail in FIG. 4, has a first threaded region 334, at the first end 332A, for mate coupling with the perforating gun assembly 310. Body 332 also has a second threaded region 336, at the second end 332B, for mate coupling with the adapter 360. Various recesses 337 and 338 are formed in the body 332, at each of the two ends 332A and 332B, for receiving O-rings 380B and 380C to achieve a seal between the perforating gun assembly and the switch sub, and another seal between the adaptor and the switch sub.

Figure 4:
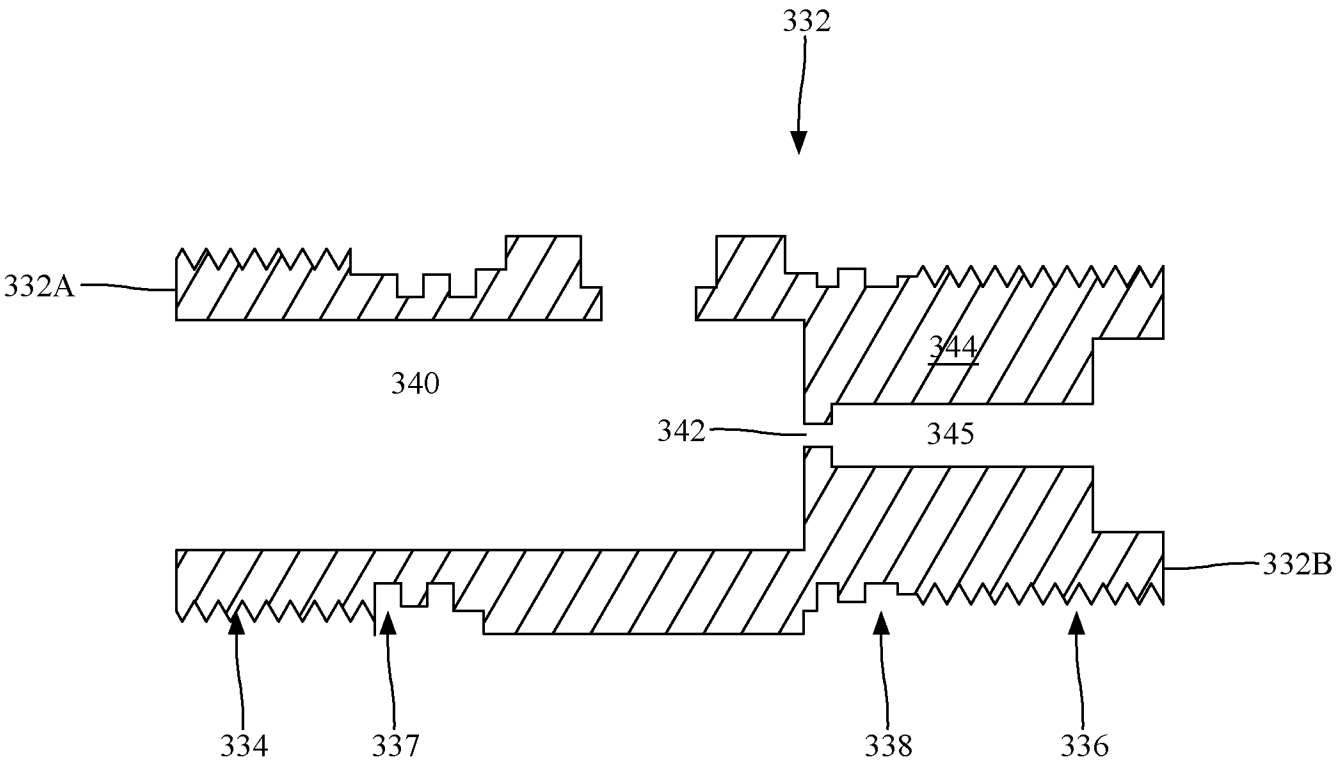
FIG. 4 illustrates a switch sub of the downhole tool.

The bore/chamber 340 is formed inside body 332 and connects to the perforating gun assembly 310. Bore/chamber 340 is constricted toward the adapter 360 to a small bore 342, that allows one or more electrical wires (e.g., wires 322 and 324) to pass from bulkhead bore 345 to bore/chamber 340. Bulkhead 344 is formed in the body 332 of the switch sub, toward the second end 332B. Igniter system 320 is designed to snugly fit inside bulkhead bore 345 as shown in FIG. 3. In one embodiment, bulkhead 344 is already present in the existing switch subs, and thus, there is no need to retrofit the existing downhole equipment for housing the igniter system 320 inside the body 332 of the switch sub 330. Note that the igniter system in the embodiment shown in FIGS. 3 and 4 is located in its entirety inside the switch sub 330.

Returning to FIG. 3, the igniter system 320 may have two wires, a ground wire 322 and a signal wire 324. FIG. 3 shows that an opening 343 is formed in the body 332 of the switch sub 330, and this opening may be closed with a cap 345. This opening may be used for forming electrical contacts between the wires of the igniter system and a switch and/or detonator. Bore/chamber 340 may house various electronic components, e.g., switch 346 that sends the firing signal to the igniter system 320. In one application, switch 346 may also send a firing signal to a detonator 312, located inside perforating gun assembly 310. Detonator 312, when activated, may detonate a detonator cord 314 for firing the various shape charges (not shown) of the perforating gun assembly 310.

Still with regard to FIG. 3, a cartridge 350 (for example, made out of copper) may be attached to or may be part of the igniter system. Cartridge 350 may include an energetic material 352, which produces the flame that would ignite a power charge 376 located inside the setting tool 370. The igniter system 320 and cartridge 350 are locked inside the bulkhead bore 345 with a nut 354. Thus, in this embodiment, the entire igniter system 320 is located in the second end 332B of the switch sub 330. This means that switch sub 330 now includes not only the switch 346, but also the igniter system 320. However, in another embodiment, which will be discussed later, the igniter system may house the energetic material 352 and thus, the cartridge 350 may not be necessary or it is part of the housing of the igniter system.

Figure 5:
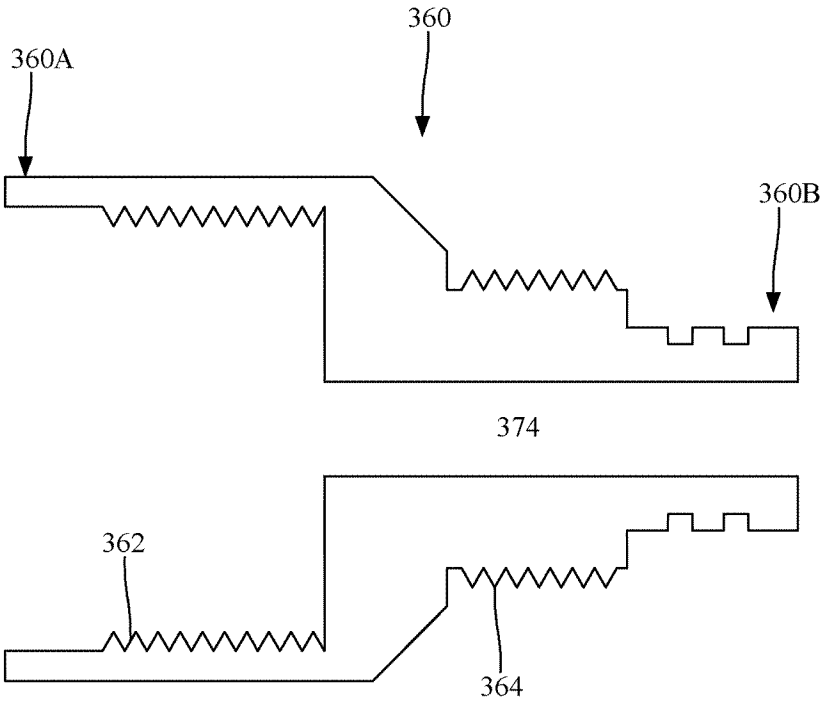
FIG. 5 illustrates an adapter of the downhole tool.

FIG. 3 also shows adapter 360 being mate connected to the second end 332B of the switch sub 330 and to a first end 370A of the setting tool 370. Adapter 360 has internal threads 362 at a first end 360A, that match the threads 336 on the switch sub 330, and also has external threads 364 at a second end 360B, that match the internal threads 372 of the setting tool 370. Adapter 360 has an internal chamber (or bore) 374 (see FIGS. 3 and 5) through which the flame produced by the igniter system 320 propagates to the power charge 376. O-ring 380A may be located between the first end 332A of the switch sub 330 and the perforating gun assembly 310, O-ring 380B may be located between the second end 332B of the switch sub 330 and the first end 360A of adapter 360, and O-rings 380C and 380D may be located between the second end 360B of the adapter 360 and the first end 370A of the setting tool 370. The O-rings are added to this system for preventing the fluids from the well from entering inside the downhole system 300.

Figure 6:
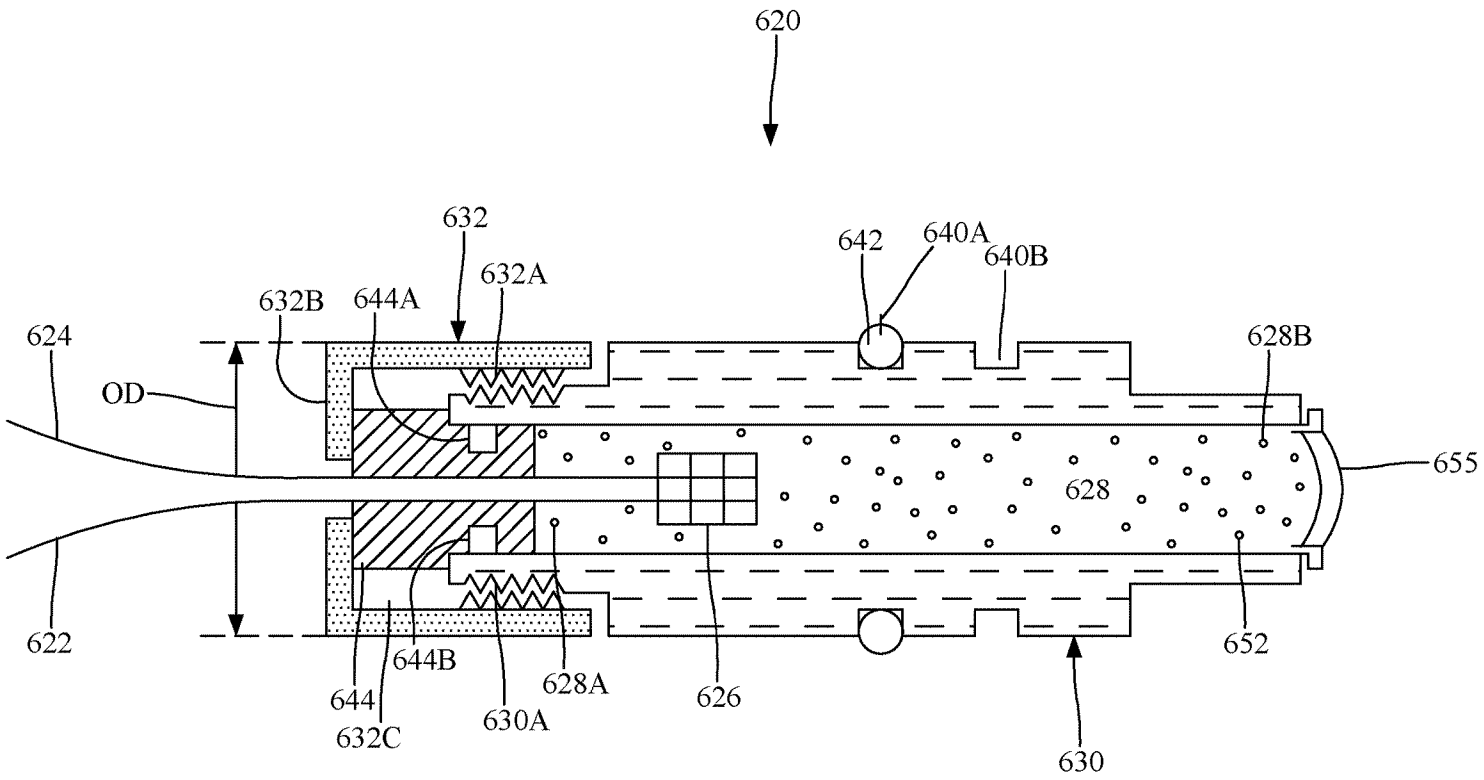
FIG. 6 illustrates the igniter system.

To prevent the smoke and/or soot from the burning power charge 376 to propagate inside the switch sub, the igniter system 320 is manufactured in a novel way and/or located at a new position inside the downhole tool, as now discussed. FIG. 6 shows one such igniter system 620. Other igniter systems are discussed later. Igniter system 620 includes an igniter 626 located in a chamber/bore 628 of a first igniter housing 630. The first igniter housing 630 is attached to a second igniter housing 632. The two igniter housings 630 and 632 have corresponding threads 630A and 632A for mating to each other. The first igniter housing 630 also houses the energetic material 652. The first igniter housing may be made of aluminum, metal, composite material or any other material that can withstand the burning of the energetic material. In one application, the energetic material 652 is part of the igniter system 620. In another application, the energetic material 652 is part of the igniter 626.

The second igniter housing 632, which can also be made of the same material as the first igniter housing, ensures that the igniter 626 and the associated ground wire 622 and signal wire 624 are not pushed into the switch sub 330, when the explosive material 652 is ignited. In other words, the second igniter housing is a reinforcing cap that enhances the pressure rating and makes the form factor of the igniter to match the existing bulkhead. The second igniter housing also enables an aluminum body for the first igniter housing. Thus, the first and second igniter housings 630 and 632 maintain the integrity of the igniter system and prevent the soot and smoke from propagating to the switch sub 330.

To achieve this goal, the external diameters OD of the first and second igniter housings 630 and 632 are the same and selected to fit snugly inside bulkhead bore 345. Further, recesses 640A and 640B are formed in the first igniter housing 630 for receiving O-rings 642 (only one shown for simplicity) to further seal the space between the inside of the bulkhead 344 and the exterior of the first igniter housing 630.

To prevent the smoke and/or soot to propagate from the burnt energetic material 652 and/or the power charge 376 though the inside of the first and second igniter housings 630 and 632, a seal element 644 is placed in the second igniter housing 632, between the igniter 626 and the interior of the switch sub 330. In one application, as shown in FIG. 6, the seal element 644 is placed to contact an end wall 632B of the second igniter housing 632. The seal element 644 in this embodiment partially extends inside the first igniter housing 630 and directly contacts an inside wall of the first igniter housing. To further increase the seal function of the seal element 644, a recess 644A may be formed in the body of the seal element, at the end of the seal element that is located inside the first igniter housing, and an O-ring 644B may be placed in the recess 644A.

Seal element 644 may be formed to include at least one of glass, metal, glass/metal, and epoxy/metal. Seal element 644 is formed over the two wires 622 and 624. In one application, an empty chamber 632C is present after the seal element 644 has been formed inside the second igniter housing 632. Each portion of the wires 622 and 624 that are shown outside the first and second igniter housings may be protected with a corresponding heat shrink cover and both portions may also be covered with a single heat shrink cover.

Igniter 626 may include a single resistor or two resistors for igniting the energetic material 652. If two resistors are included, they may be connected in parallel so that one resistor is redundant. The two resistors may also be connected in series. The current provided between the signal wire 624 and the ground wire 622 would increase the temperature of the resistor so that it eventually ignites the energetic material. In one application, the igniter 626 may include an igniter match head (i.e., a low voltage pyrotechnic), a bridge wire, a Ni—Cd wire or any other known element that can ignite the energetic material.

Returning to FIG. 6, the bore 628 in the first igniter housing 630 has a first end 628A that is closed by the seal element 644 and a second end 628B, opposite to the first end 628A, which is closed by an insert 655. In one embodiment, insert 655 is a thin aluminum foil having the purpose of preventing the energetic material 652 from spilling out of the bore 628. Other materials may be used for the insert.

Figure 7:
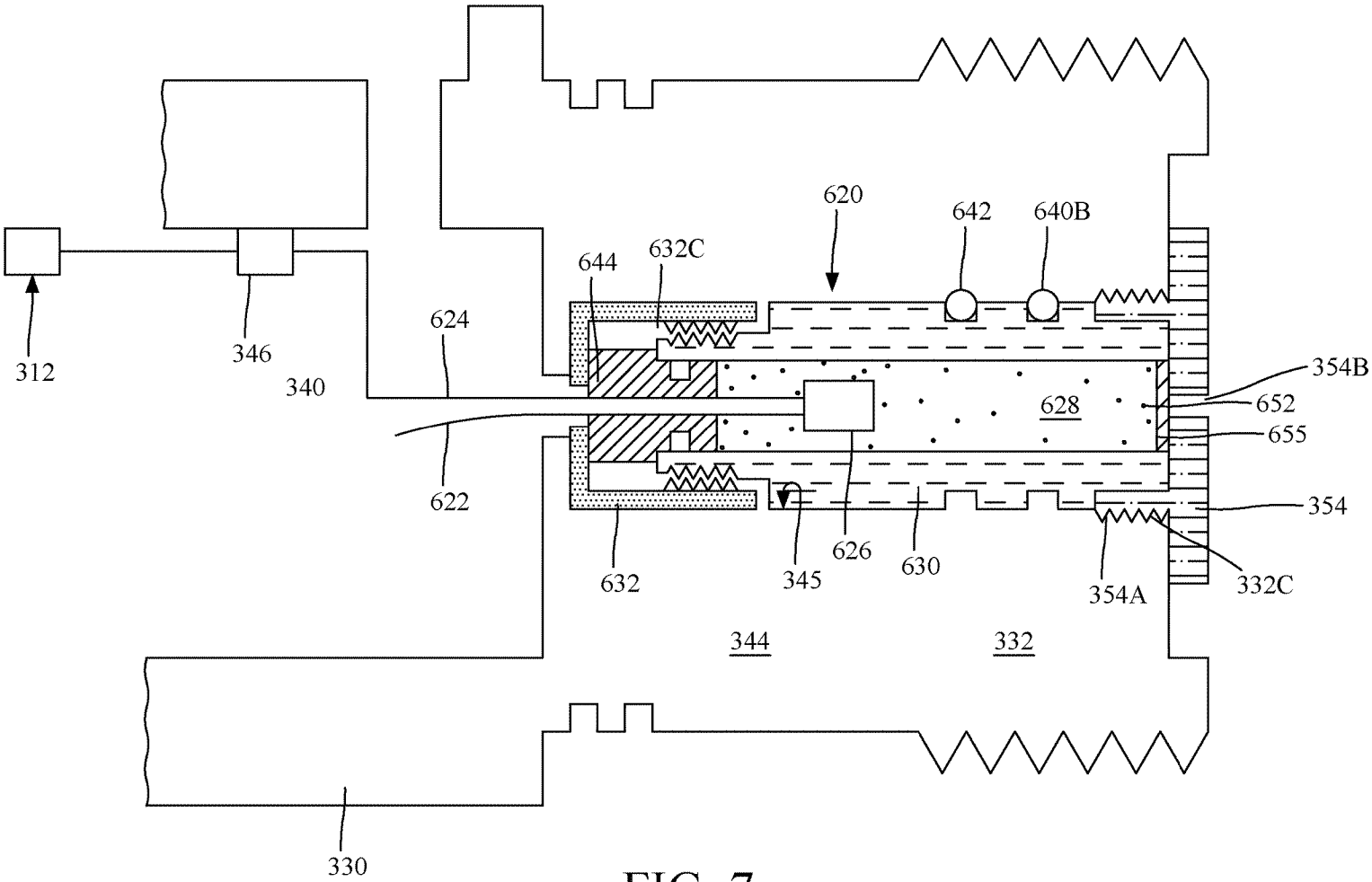
FIG. 7 illustrates the igniter system located inside the switch sub.

When the igniter system 620 is placed inside the bulkhead bore 345 of switch sub 330, as illustrated in FIG. 7, a nut 354 is attached with a thread 354A to a corresponding thread 332C formed in the inside part of the body 332 of the switch sub 330. Nut 354 (or an equivalent device) holds in place the first and second igniter housings 630 and 632. Nut 354 has an opening 354B that allows the flames from the energetic material 652 to travel to the power charge 376, in the setting tool, to ignite it. FIG. 7 shows that in this embodiment, the entire igniter system 620 is located entirely inside the switch sub 330. In fact, in this embodiment, the entire igniter system 620 is located entirely inside the bulkhead bore 345 of the switch sub.

Figure 8:
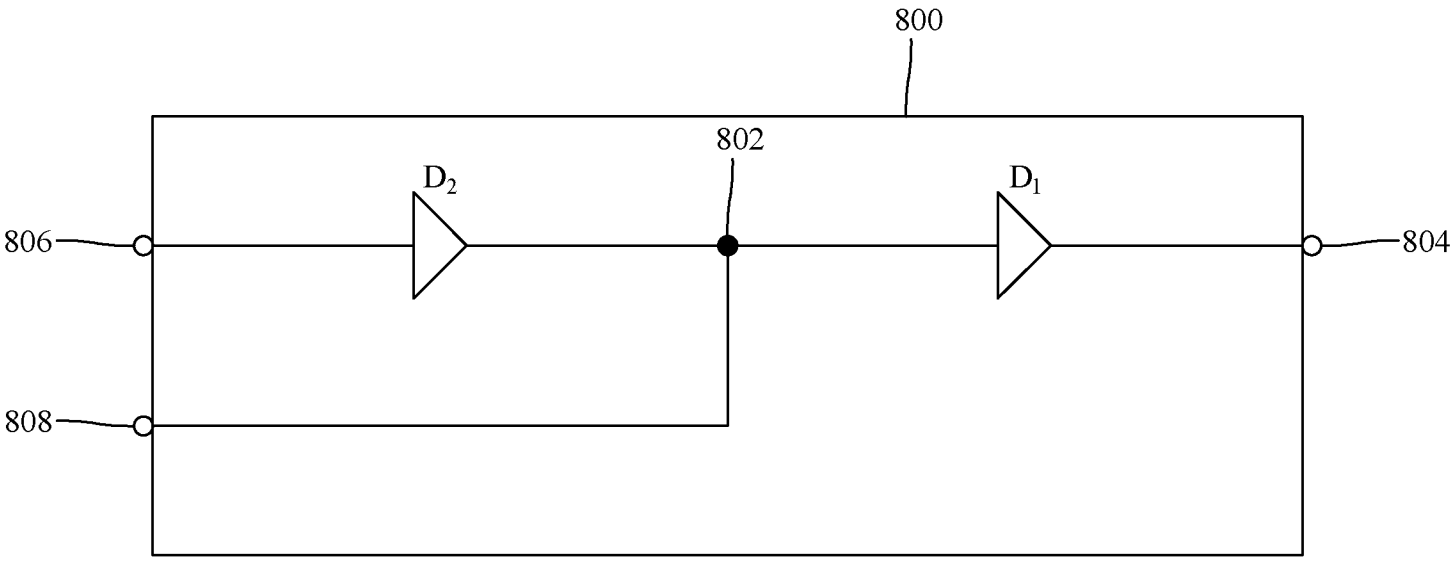
FIG. 8 illustrates a switch of the switch sub.

In one embodiment, signal wire 624 of the igniter system 620 may be attached to the switch 346 as shown in FIG. 7. Switch 346 may have a structure as illustrated in FIG. 8. Switch 346 may include a housing 800 that houses first diode D1 and second diode D2, which are connected to a common point 802. First diode D1 is connected to an igniter port 804 (which can be a simple wire), which is configured to be connected to the signal wire 624 of the igniter system 620. Second diode D2 is connected to the common point 802 and to a detonator port 806. Detonator port 806 is configured to be connected to a detonator 312 of the perforating gun assembly. Common point 802 is electrically connected to through port 808. Through port 808 is configured to be electrically connected to the wireline.

Figure 9:
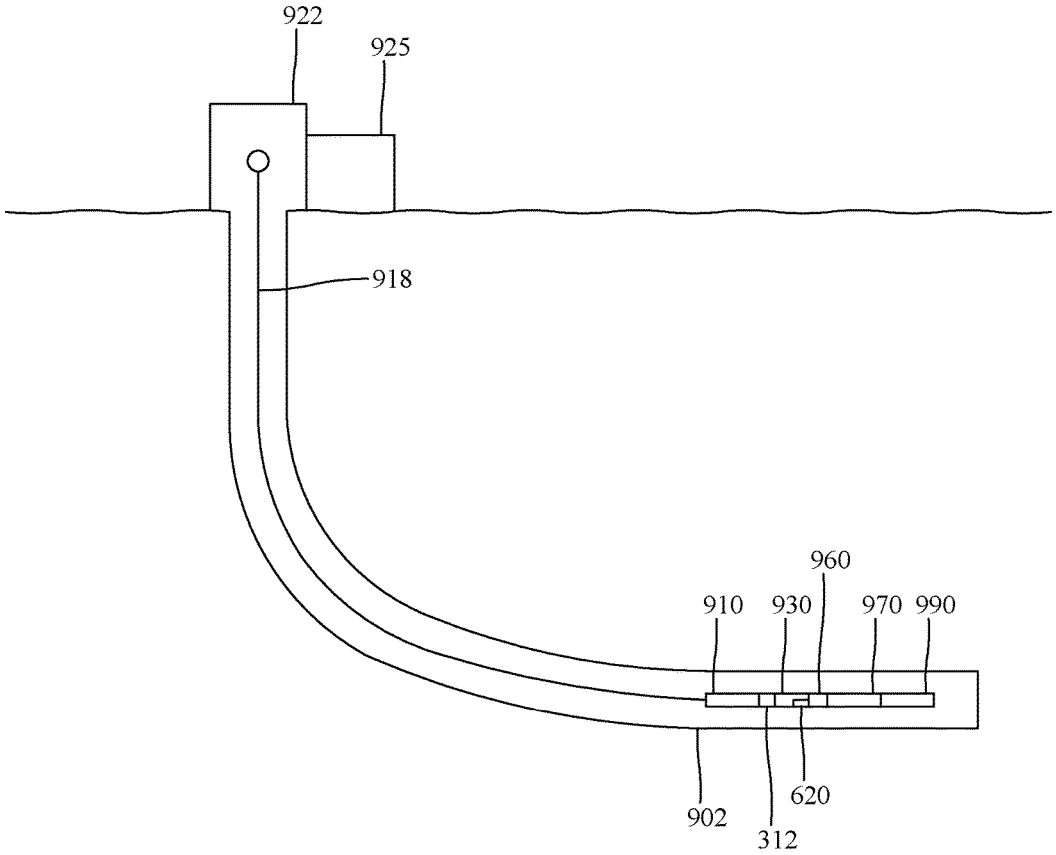
FIG. 9 illustrates the downhole tool located inside a well.

When in use, as illustrated in FIG. 9, the operator of the downhole tool sends from a surface control system 925 a first signal (in this case a positive direct current) to the through port 808 through the wireline 918. The first signal, because of its positive polarity, is prevented to travel across the second diode D2, to the detonator 312 of the perforating gun assembly 910. The first signal can only travel across the first diode D1, to the igniter port 804, thus igniting the igniter system 620 located inside the switch sub 930. After the setting tool 970 was activated and the plug 990 was set (note that an adapter 960 may be present to mechanically connect the switch sub 930 to the setting tool 970), the operator retrieves the system for a predetermined distance and then sends a second signal (in this case a negative direct current) down the wireline 918. This second signal will pass across the second diode D2 and arrives at the detonator 312, to detonate the shape charges in the perforating gun assembly 914 and perforate the casing 902.

Instead of having the first and second diodes oriented as shown in FIG. 8, in one application, it is possible to reverse the polarity of the diodes and then use a negative signal to activate the igniter and a positive signal to activate the detonator. Those skilled in the art would understand that other switches may be used, for example, pneumatic switches or optical switches or addressable switches that include at least one integrated circuit, or any available switch.

The energetic material 652 and/or the power charge 376 may include any of: a metal based explosive (e.g., magnesium, pyrenol, phosphorus, thermite), firearm propellants (e.g., black powder, pyrodex, nitrocellulose, picrate), rocket propellants (e.g., ammonium perchlorate), high explosives (e.g., PYX, RDX, NONA, HMX, PETON, HNS), or any other known energetic material.

The igniter system discussed herein has been shown to fit in a two-piece housing 630 and 632. However, those skilled in the art would understand that the two-piece housing may be replaced with a single-piece housing or a three-piece housing. In one application, the igniter system may be fitted into the quick change tool. In another application, the igniter system may include an igniter with a "spring" as is used traditionally in the industry. The igniter system may be integrated with a pressure switch or it may incorporate an addressable switch.

Figure 10:
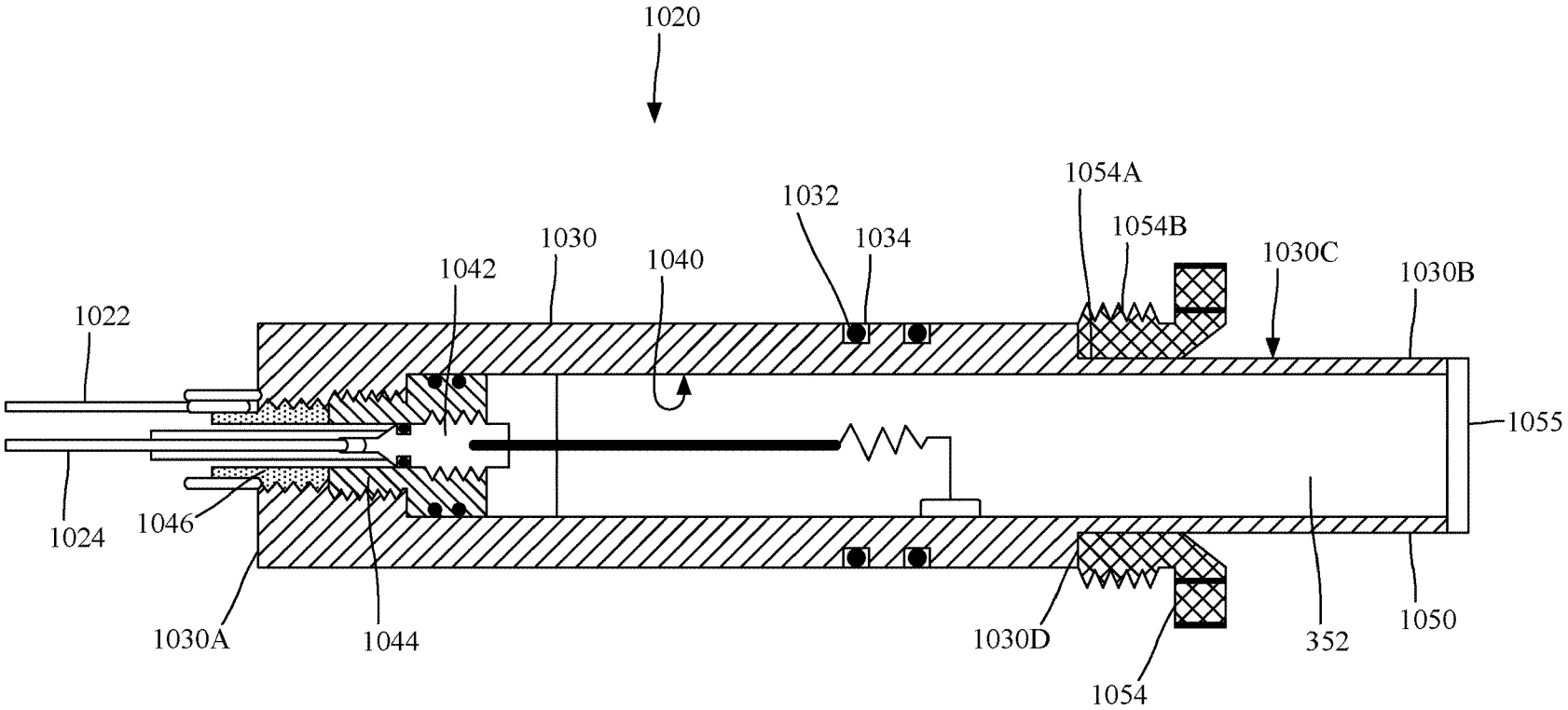
FIG. 10 illustrates another igniter system.

FIG. 10 illustrates another possible implementation 1020 of the igniter system 320 discussed with regard to FIG. 3. Igniter system 1020 is different from the igniter system 620 in a couple of features. First, igniter system 1020 has the energetic material 352 located in a cartridge 1050 that may or may not be part of the housing of the igniter system 1020. Second, the energetic material 352 may extend beyond the nut 1054 that attaches the igniter system 1020 to the bulkhead in the switch sub. This means that igniter system 1020 may be located partially in the switch sub and partially in the adapter. However, similar to the embodiment of FIG. 6, the igniter system is not located in the setting tool. These and other features are now discussed with regard to FIGS. 10 and 11.

FIG. 10 shows the igniter system 1020 having a housing 1030. Housing 1030 has a first end 1030A that faces the switch sub 330 and a second end 1030B, opposite to the first end 1030A, and facing the setting tool. The housing 1030 is machined to snugly fit inside the bulkhead bore 345 formed inside the switch sub 330 (see FIG. 3). One or more recesses 1032 (two are shown in the figure) may be formed in the housing 1030 to accommodate corresponding O-rings 1034, to achieve a seal between the interior of the bulkhead and the exterior of the igniter system 1020. Housing 1030 has a thinner wall region 1030C (i.e., a thickness of the wall of the housing 1030 in between the first and second ends 1030A and 1030B is larger than a thickness of the wall of the housing at region 1030C) that faces the setting tool. A shoulder 1030D formed in the housing 1030 borders the thinner wall region 1030C. This thinner wall region 1030C may be configured to extend past the switch sub 330, as illustrated in FIG. 3. In other words, a portion of the housing 1030 in this embodiment enters inside the adapter 360 in FIG. 3, if such an adapter is present.

Nut 1054 is configured to have an opening 1054A large enough to move over the thinner wall region 1030C. Nut 1054 is configured with threads 1054B that mate with corresponding threads formed inside the body of the switch sub 330, as illustrated in FIG. 3. Nut 1054 is configured to contact shoulder 1030D when fully connected, to firmly hold housing 1030 inside the bulkhead bore 345 of the switch sub.

Housing 1030 has a bore 1040 in which the igniter 1042 and the energetic material 352 are placed in. Igniter 1042 is schematically illustrated in FIG. 10 as including a resistor connected to the housing for closing an electrical circuit between the ground wire 1022 and the signal wire 1024. However, as discussed above with regard to the igniter system 620, the igniter 1042 may include plural resistors, or other components. The energetic material 352 may include any of the substances discussed above with regard to the embodiment of FIG. 6. Housing 1030 is closed at the second end 1030B with an insert 1055, which may be made of a material identical to the insert 655 in FIG. 6. The walls of the housing 1030 may be made of the same material as the housing 630 in the embodiment of FIG. 6.

Figure 11:
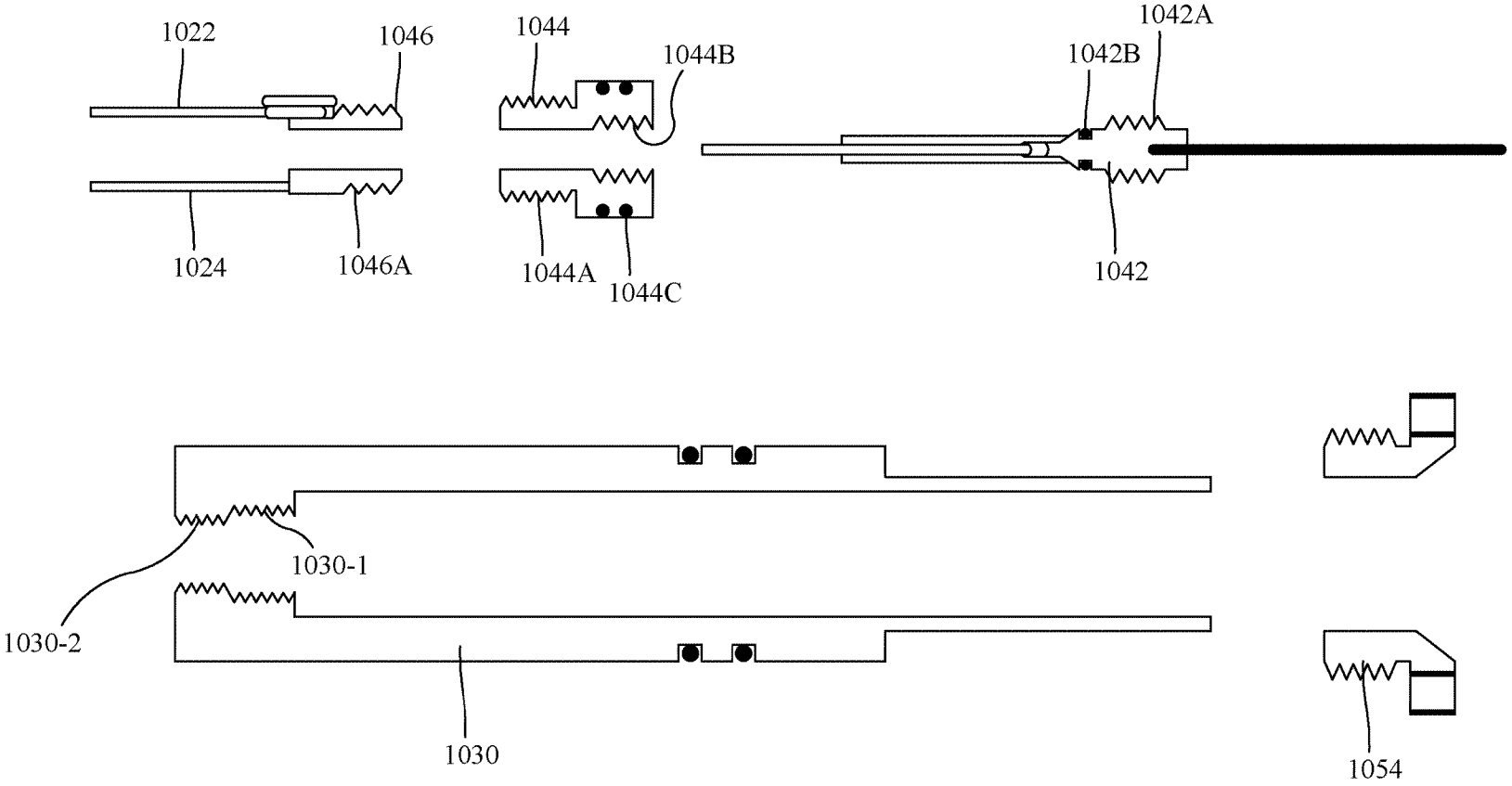
FIG. 11 illustrates the components of the igniter system.

Igniter 1042 is attached in this embodiment to the housing 1030 through first and second thread adapters 1044 and 1046. These thread adapters, which are also shown in FIG. 11, are configured to have threads so that the first thread adapter 1044 and the second thread adapter 1046 can be attached to an interior of the housing 1030. In one embodiment, the first thread adapter is in contact with the second thread adapter when in their final position, as illustrated in FIG. 10.

FIG. 11 shows the first thread adapter 1044 having external threads 1044A that mate with internal threads 1030-1 of the housing 1030. FIG. 11 further shows the second thread adapter 1046 having external threads 1046A that mate with internal threads 1030-2 of the housing 1030. An external diameter of the first thread adapter 1044 is larger in this embodiment then an external diameter of the second thread adapter 1046. The first thread adapter 1044 also have first internal threads 10446 that mate with external threads 1042A of igniter 1042. Each of the first thread adapter 1044 and the igniter 1042 have corresponding recesses 1044C and 1042B configured to receive corresponding O-rings for preventing the smoke and/or soot that results after burning the energetic material 352 from passing through the inside of the housing 1030.

FIG. 11 also shows wires 1022 and 1024 being solid wire connections, which are different from many existing igniters that use a pin and spring connection. Further, by using the first and second thread adapters 1044 and 1046, a built in pressure barrier is obtained between the igniter side and the inside of the switch sub.

Figure 12:
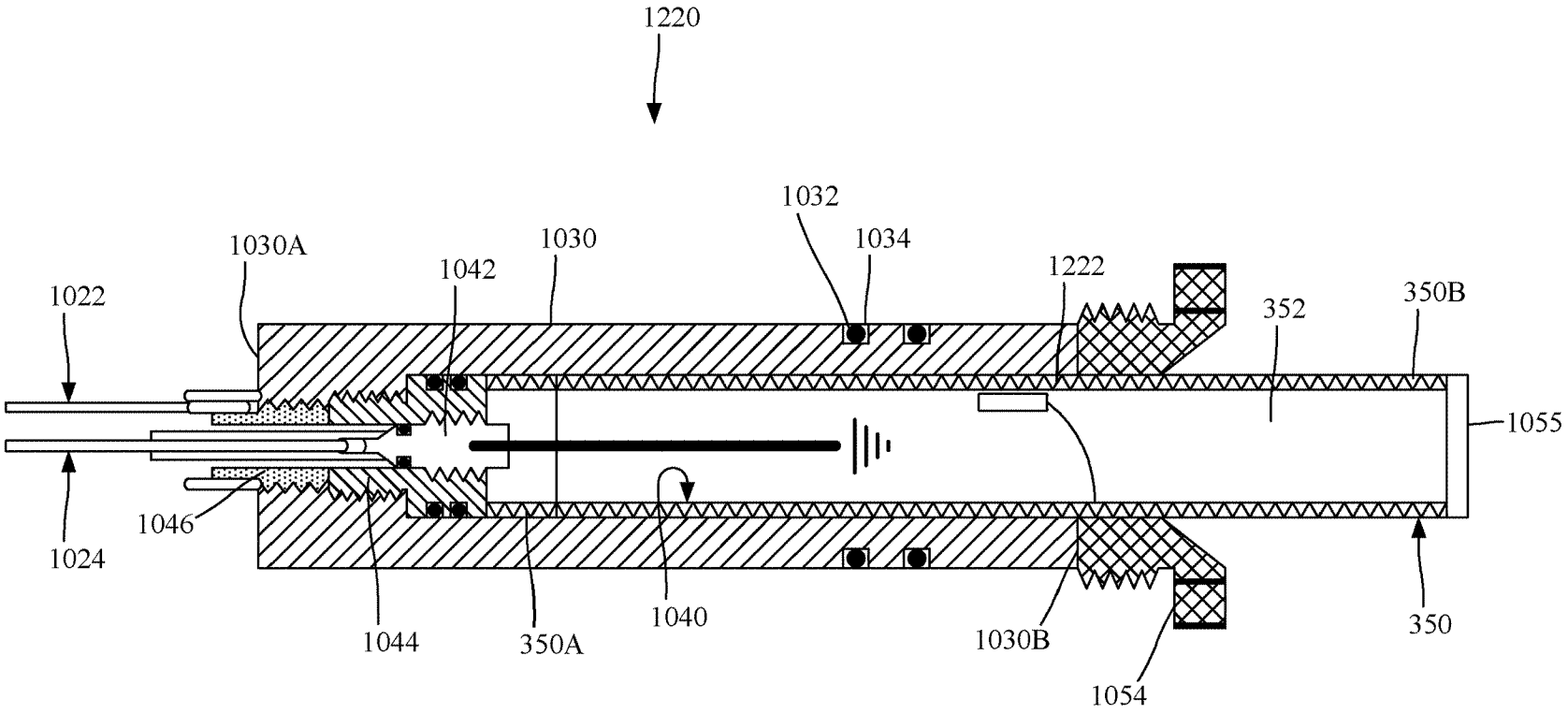
FIG. 12 illustrates still another igniter system.

FIG. 12 shows another possible implementation 1220 of the igniter system 320 discussed with regard to FIG. 3. Igniter system 1220 is similar to igniter system 1020 shown in FIGS. 10 and 11 except that housing 1030 does not have the thinner wall region 1030C. In the present embodiment, the second end 10306 of housing 1030 is facing the nut 1054. The energetic material 352 is located inside a cartridge 350 that snugly fits inside bore 1040 of housing 1030. Cartridge 350 is made of copper (it can be made of any material) and has a first end 350A connected to the igniter 1042 and a second end 350B closed by an insert 1055, which may be identical to the insert 655 discussed above with regard to the embodiment of FIG. 6. In this embodiment, the cartridge 350 is attached to the igniter 1042 and then the entire assembly is placed inside the housing 1030 of the igniter system 1220. The first and second thread adapters 1044 and 1046 may have the same configuration as in the embodiments illustrated in FIGS. 10 and 11. Igniter 1042 may be any type of igniter, similar to the igniter 626 discussed in FIG. 6.

Further, in this embodiment, an additional ground wire 1222 connects the housing 1030 to the energetic material 352 so that an electrical circuit can be established together with the signal wire 1024 inside the energetic material for igniting it.

It is noted that all the above discussed igniter systems fit inside of an existent bulkhead. This means that whatever the size of the bulkhead, the igniter systems discussed above may be manufactured to retrofit any existing bulkhead present in downhole tools. Thus, the present invention can be applied to any existing downhole tool. The present embodiments can also use any type of igniter. By moving the igniter from the setting tool into the switch sub, a length of the entire downhole tool may be reduced by 12 to 18". The discussed embodiments also show a reduced firing head, for example, to a simple threaded adapter, while a solid line of continuity with no pin and seat contacts is achieved.

Figure 13:
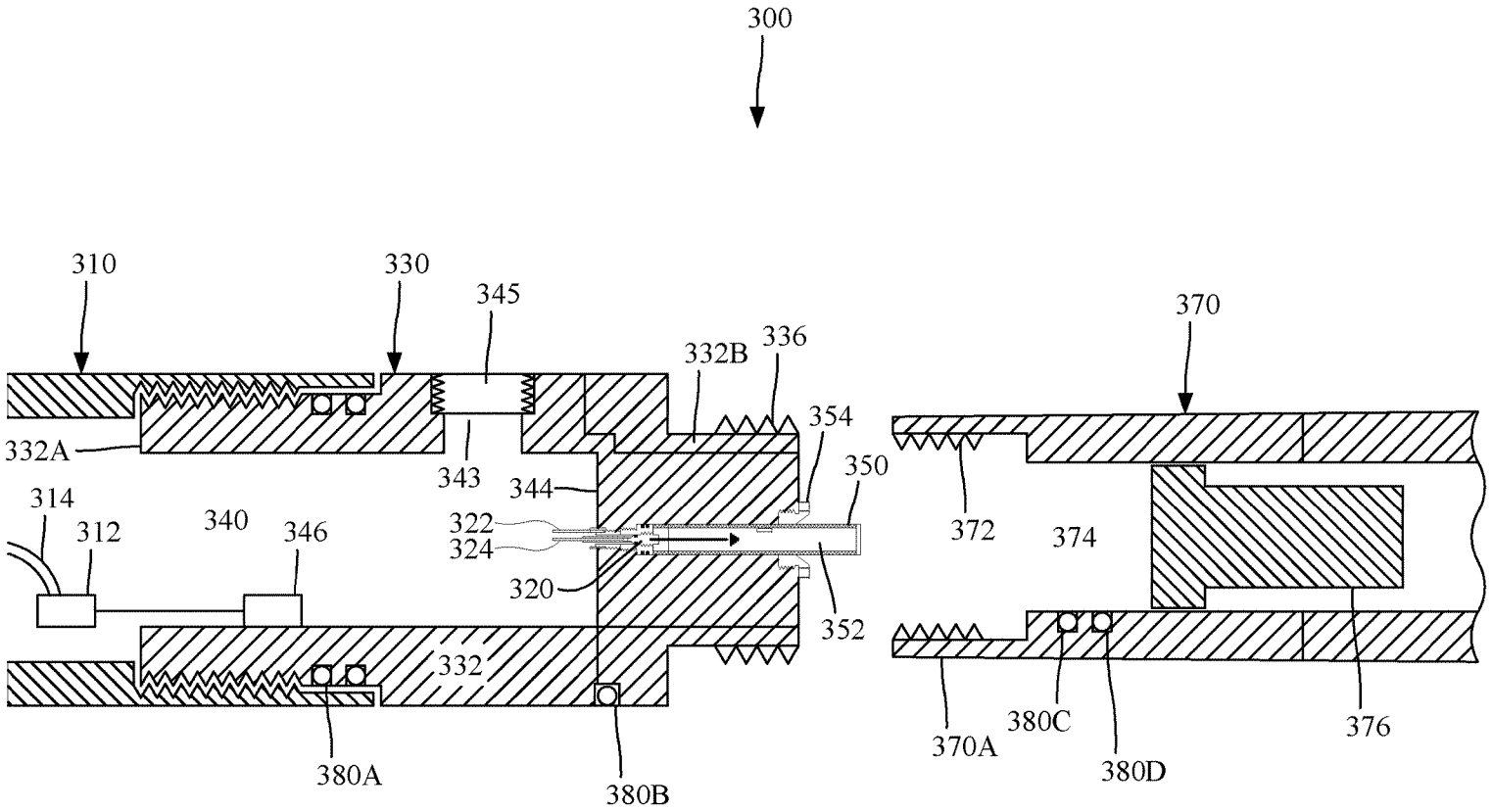
FIG. 13 illustrates a downhole tool in which a setting tool attaches directly to a switch sub.

In one embodiment, even the threaded adapter 360 shown in FIG. 3 may be omitted. In this embodiment, which is illustrated in FIG. 13, the end 332B of the body 332 is machined to have an outer diameter that fits an inside diameter of the first end 370A of setting tool 370. For this case, external threads 336 are formed directly in the body 332, at end 332B and not in the adapter 360, as in the embodiment of FIG. 3. This means that external threads 336 of the switch sub mate directly to internal threads 372 of setting tool 370 Further, the external diameter of first end 332A of body 332 is larger than the external diameter of second end 332B. In this way, the last switch sub of the perforating gun assembly is different from the other switch subs used between the various guns of the perforating gun assembly. In this regard, note that a switch sub that connects two consecutive guns to each other have the same external diameter for both ends. Also note that the sealing feature (e.g., grooves and o-rings) between the switch sub and setting tool are omitted for simplicity.

Figure 14:
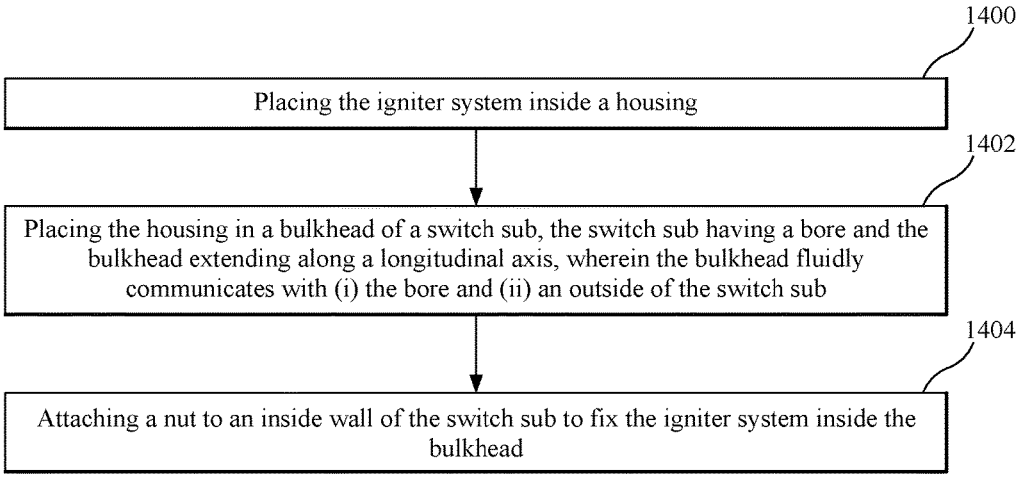
FIG. 14 is a flowchart of a method for manufacturing an igniter system.

A method for manufacturing the novel igniter system noted above is discussed now with regard to FIG. 14. The method includes a step 1400 of placing the igniter system inside a housing; a step 1402 of placing the housing in a bulkhead of a switch sub, the switch sub having a bore, and the bore and the bulkhead extending along a longitudinal axis. The bulkhead fluidly communicates with (i) the bore and (ii) an outside of the switch sub. The method also includes a step 1404 of attaching a nut to an inside wall of the switch sub to hold the igniter system inside the bulkhead. The igniter system is configured to ignite an energetic material partially located inside the switch sub. In one optional step, the igniter system is sealed.

The disclosed embodiments provide methods and systems for providing an igniter system in a switch sub. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A downhole tool comprising:

a switch sub having a bore and a bulkhead extending along a longitudinal axis, wherein the bulkhead has a bulkhead bore that fluidly communicates with (i) the bore and (ii) an outside of the switch sub; and an igniter system located inside the bulkhead and having a housing that extends partially inside the bulkhead and partially inside a bore of an adapter, wherein the adapter attaches to the switch sub, and wherein the igniter system is configured to ignite an energetic material.

2. The downhole tool of claim 1, wherein the entire igniter system is located within the switch sub.

3. The downhole tool of claim 1, further comprising:

an adapter that connects the switch sub to a setting tool, wherein the igniter system is located partially in the switch sub and partially in the adapter.

4. The downhole tool of claim 3, wherein no part of the igniter system is located inside the setting tool.

5. The downhole tool of claim 4, further comprising:

a plug connected to the setting tool, wherein the plug is set by the setting tool to close a well.

6. The downhole tool of claim 1, wherein the igniter system comprises:

an igniter housing the energetic material and configured to ignite the energetic material;

a first igniter housing; and a second igniter housing that connects to the first housing, wherein the igniter is fully contained inside the first and second igniter housings and the first and second igniter housings fit an-inside of the bulkhead.

7. The downhole tool of claim 6, wherein the first and second igniter housings are made out of aluminum.

8. The downhole tool of claim 6, wherein the igniter system further comprises:

a seal element that insulates an interior of the first igniter housing from an interior of the second igniter housing.

9. The downhole tool of claim 8, wherein the seal element has a glass or metal composition.

10. The downhole tool of claim 8, wherein a ground wire and a signal wire of the igniter extend from the second igniter housing to the bore of the switch sub.

11. The downhole tool of claim 1, further comprising:

a switch located inside the bore of the switch sub, wherein the igniter system is electrically connected to the switch sub.

12. The downhole tool of claim 1, wherein the igniter system further comprises:

a first thread adapter that attaches to an inside of the housing; and an igniter that attaches to an inside of the first thread adapter.

13. The downhole tool of claim 12, wherein the igniter system further comprises:

a second thread adapter that attaches to the inside of the housing, wherein the second thread adapter abuts the first thread adapter.

14. The downhole tool of claim 13, wherein the second thread adapter, the first thread adapter and the igniter are located in this order inside the housing.

15. The downhole tool of claim 13, wherein the igniter system further comprises:

a nut that slides over a part of the housing for attaching to the switch sub to hold the igniter system within the switch sub.

16. The downhole tool of claim 1, wherein a setting tool for setting a plug is being directly attached to an end of the switch sub where the igniter system is located.

17. The downhole tool of claim 1, wherein a setting tool for setting a plug houses a power charge to be ignited by the energetic material, and wherein the energetic material is partially located within the switch sub.

18. A downhole tool comprising:

a switch sub configured to be connected between (i) a perforating gun assembly and (ii) an adapter for a setting tool; and an igniter system located inside a bulkhead of the switch sub, the igniter system haying a housing that extends partially inside the bulkhead and partially inside a bore of the adapter, wherein the adapter attaches to the switch sub, and wherein the igniter system is configured to ignite an energetic material.

19. The downhole tool of claim 18, wherein the igniter system is located within a bulkhead bore formed in the bulkhead of the switch sub.

20. The downhole tool of claim 19, wherein the igniter system is entirely located inside the switch sub.

21. A method for manufacturing an igniter system for a downhole tool, the method comprising:

placing the igniter system inside a housing;

placing the housing in a bulkhead of a switch sub, the switch sub having a bore, and the bore and the bulkhead extending along a longitudinal axis, wherein a bulkhead bore of the bulkhead fluidly communicates with (i) the bore and (ii) an outside of the switch sub; and attaching a nut to an inside wall of the switch sub to hold the igniter system within the bulkhead bore, wherein the igniter system is configured to ignite an energetic material, wherein the housing of the igniter system extends partially inside the bulkhead and partially inside a bore of an adapter, and wherein the adapter attaches to the switch sub.

22. The method of claim 21, further comprising:

electrically connecting an igniter of the igniter system to a switch located inside the switch sub, wherein the switch is configured to control the igniter and a detonator.

23. The method of claim 21, wherein the entire igniter system is located within the switch sub.

24. The method of claim 21, further comprising:

sealing around the igniter system.

* * * * *